US006626136B2

(12) United States Patent
Mikame et al.

(10) Patent No.: US 6,626,136 B2
(45) Date of Patent: Sep. 30, 2003

(54) VALVE TIMING CONTROL APPARATUS FOR INTERNAL COMBUSTION ENGINE

(75) Inventors: Kazuhisa Mikame, Nagoya (JP); Yoshikazu Ishii, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/095,571

(22) Filed: Mar. 13, 2002

(65) Prior Publication Data

US 2002/0092489 A1 Jul. 18, 2002

Related U.S. Application Data

(62) Division of application No. 09/431,924, filed on Nov. 2, 1999, now Pat. No. 6,386,164.

(30) Foreign Application Priority Data

Dec. 7, 1999 (JP) ..... 10-347198

(51) Int. Cl.[7] ..... F01L 1/34

(52) U.S. Cl. ..... 123/90.17; 123/90.15; 123/90.27; 123/90.31; 464/2; 464/160

(58) Field of Search ..... 123/90.15, 90.17, 123/90.27, 90.31; 464/1, 2, 160

(56) References Cited

U.S. PATENT DOCUMENTS 5,184,581 A * 2/1993 Aoyama et al. ..... 123/90.31
5,405,293 A * 4/1995 Severinsson ..... 464/2
5,738,056 A * 4/1998 Mikame et al. ..... 123/90.17
5,797,361 A * 8/1998 Mikame et al. ..... 123/90.17
5,797,363 A * 8/1998 Nakamura ..... 123/90.17
5,823,152 A * 10/1998 Ushida ..... 123/90.17
5,901,674 A 5/1999 Fujiwaki ..... 123/90.17
5,941,202 A 8/1999 Jung ..... 123/90.17
5,960,757 A * 10/1999 Ushida ..... 123/90.17
6,089,198 A 7/2000 Goppelt et al. ..... 123/90.17
6,386,164 B1 * 5/2002 Mikame et al. ..... 123/90.17

FOREIGN PATENT DOCUMENTS

| | | |
|---|---|---|
| DE | 19914767 | 10/1999 |
| JP | 4-140407 | 5/1992 |
| JP | 7-189621 | 7/1995 |
| JP | 9-324613 | 12/1997 |

* cited by examiner

*Primary Examiner*—Thomas Denion
(74) *Attorney, Agent, or Firm*—Pillsbury Winthrop LLP

(57) ABSTRACT

A valve timing control apparatus for an internal combustion engine has a lock pin that is movably provided in an accommodation hole of one of vanes of a rotor. A screw portion is formed along part of the outer circumference of the lock pin, which is fixed to a shaft of a motor. When hydraulic pressure control is performed to maintain a housing and the rotor in a predetermined intermediate phase, the lock pin moves in the axial direction of a cam shaft in response to rotation of the motor independently of the hydraulic pressure control, and engages a lock recess portion formed in a sprocket.

13 Claims, 8 Drawing Sheets

VALVE TIMING CONTROL APPARATUS FOR INTERNAL COMBUSTION ENGINE

INCORPORATION BY REFERENCE

This application is a divisional application of U.S. application Ser. No. 09/431,924, filed Nov. 2, 1999, now U.S. 6,386,164, the specification and drawings of which are incorporated herein by reference.

BACKGROUND OF THE INVENTION

1. Field of the Invention

The present invention relates to a valve timing control apparatus for variably controlling at least one of intake valves and exhaust valves of an internal combustion engine, in accordance with an operation state of the engine.

2. Description of the Related Art

Various valve timing control apparatuses have been put into practice which change valve timings of intake valves and exhaust valves in accordance with an operation state of an internal combustion engine. Further, Japanese Patent Publication Laid-Open No. HEI 9-324613 discloses a valve timing control apparatus employing vanes equipped with a lock pin. The outline of the valve timing control apparatus disclosed in this publication will be described with reference to FIGS. 11 and 12.

FIG. 11 schematically shows the structure of the valve timing control apparatus. As shown in FIG. 11, the valve timing control apparatus is composed of a variable valve timing mechanism (VVT) 212, an oil control valve (OCV) 240, an engine control unit (not shown) and the like. The engine control unit drive-controls the OCV 240 in accordance with operation control of the engine, thereby variably controlling the VVT 212.

FIG. 12 shows in cross section the structure of the VVT 212. The VVT 212 is provided on an intake-side cam shaft 211 (FIG. 11). The VVT 212 is composed of a housing 216 integrated with a sprocket 217, a rotor 219 incorporated in the housing 216 and the sprocket 217, a rear plate 214 (FIG. 11), and a front cover 220 (FIG. 11) for covering a front face of the housing 216. The rotor 219, the rear plate 214 and the like are coupled to the intake-side cam shaft 211 by means of bolts or the like such that they can rotate integrally. Further, as shown in FIG. 12, the rotor 219 is provided with four vanes 224 that are arranged at equal intervals along an outer circumference thereof and project radially.

On the other hand, in the aforementioned VVT 212, the sprocket 217 has a substantially cylindrical shape and is disposed on the outer circumference of the rear plate 214. The sprocket 217 is supported such that it can rotate relative to the rear plate 214 and the intake-side cam shaft 211. The sprocket 217 is drivingly coupled to a crank shaft (not shown). When the engine is started (comes into operation), the sprocket 217 rotates clockwise in FIG. 12 in response to rotation of the crank shaft.

Further, the housing 216, which is integrated with the sprocket 217, is provided with four protruding portions 225, which are arranged at equal intervals. Four concave portions 226 are provided to accommodate the vanes 224 of the rotor 219, and each of the concave-portions 226 is formed between adjacent ones of the protruding portions 225. With each of the vanes 224 being disposed in a corresponding one of the concave portions 226, an advancement hydraulic chamber 230 and a retardation hydraulic chamber 231 are formed on opposite sides of each of the vanes 224.

In a state where oil is supplied to both the hydraulic chambers 230 and 231, the rotor 219 and the sprocket 217 are coupled to each other at a relative angle corresponding to a pressure balance of the oil. In response to rotation of the sprocket 217, the rotor 219 and the cam shaft 211 are rotated.

If the pressure in the retardation hydraulic chamber 231 becomes higher than the pressure in the advancement hydraulic chamber 230, the vanes 224 rotate counterclockwise in FIG. 12. Then, each of the vanes 224 comes into abutment on one of the inner walls of a corresponding one of the protruding portions 225. In this state, the cam shaft 211 is in its most receded position with respect to the crank shaft. At this moment, the valve timing of intake valves (not shown), which are driven in response to rotation of the cam shaft 211, is also most retarded. Conversely, if the pressure in the advancement hydraulic chamber 230 becomes higher than the pressure in the retardation hydraulic chamber 231, the vanes 224 rotate clockwise in FIG. 12. Then, each of the vanes 224 comes into abutment on the other of the inner walls of a corresponding one of the protruding portions 225. In this state, the cam shaft 211 is in its most advanced position with respect to the crank shaft. At this moment, the valve timing of the intake valves (not shown), which are driven in response to rotation of the cam shaft 211, is also most advanced.

The VVT 212 is provided with a lock mechanism employing a lock pin. This lock mechanism will now be described.

As shown in FIG. 12, an accommodation hole 232, which extends parallel to the axis of the cam shaft 211, is formed in one of the protruding portions 225 within the housing 216. A lock pin 233 is slidably accommodated in the accommodation hole 232. A lock recess portion 234 (FIG. 11), which is opposed to the accommodation hole 232, is formed in the rear plate 214.

Further, a ring-like hydraulic chamber 249 is formed in the accommodation hole 232. The pressure of the oil supplied to the hydraulic chamber 249 acts on the lock pin 233. For this purpose, the oil supplied to the advancement hydraulic chamber 230 or the retardation hydraulic chamber 231 is used. The lock pin 233 is constantly urged in such a direction as to engage the lock recess portion 234 by a spring 235, which is interposed between the lock pin 233 and the front cover 220.

Accordingly, in the case where the force acting on the lock pin 233 based on an oil pressure becomes smaller than an urging force of the spring 235, for example, in stopping or starting the engine, the lock pin 233 engages the lock recess portion 234 of the rear plate 214 at a predetermined angle relative to the sprocket 217. At this moment, the sprocket 217 is mechanically coupled to the rear plate 214. Then, the rotor 219 and the sprocket 217 rotate integrally, for example, at a predetermined relative angle $\beta$ as shown in FIG. 12. That is, each of the vanes 224 is advanced from the most retarded position by the predetermined angle $\beta$.

On the contrary, in the case where the force acting on the lock pin 233 based on an oil pressure becomes greater than an urging force of the spring 235, for example, during operation of the engine, the lock pin 233 is released from the lock recess portion 234. Then, relative rotation between the sprocket 217 and the rear plate 214, namely, between the sprocket 217 and the rotor 219 is permitted.

In this valve timing control apparatus, the relative angle between the rotor 219 and the sprocket 217 at the time of engagement of the lock pin 233 with the lock recess portion 234 is selected so as to correspond to a valve timing that does not adversely affect startability of the engine. By selecting the relative angle between the two members, as it were, as an intermediate phase, the variable valve timing zone can be enlarged in response to assurance of startability of the engine.

In this manner, by setting the phase between the rotor 219 and the sprocket 217 at the time of engagement of the lock pin 233 with the lock recess portion 234 to the aforementioned intermediate phase, desirable characteristics of the valve timing control apparatus such as assurance of startability of the engine, enlargement of the variable valve timing zone, and the like can be obtained. However, an apparatus that performs the aforementioned phase control or operation control of the lock pin 233 using a hydraulic pressure in the engine cannot avoid the following inconveniences.

That is, according to the aforementioned valve timing control apparatus, in a state where the hydraulic pressure is low in stopping or starting the engine, appropriate engagement of the lock pin 233 cannot be achieved. In other words, the controllability in the aforementioned intermediate phase deteriorates significantly.

SUMMARY OF THE INVENTION

It is an object of the present invention to provide a valve timing control apparatus for an internal combustion engine that can enhance controllability in an intermediate phase even when stopping or starting the engine with certainty.

In a first aspect of the present invention, there is provided a valve timing control apparatus for an internal combustion engine which includes a rotational body, a cam shaft, a hydraulic chamber, a hydraulic pressure control system, a lock mechanism and a lock mechanism control system. The rotational body is drivingly coupled to an output shaft of the internal combustion engine. The cam shaft drivingly opens and closes valves of the internal combustion engine. The hydraulic chamber changes a rotational phase between the output shaft and the cam shaft through supply of a hydraulic pressure. The hydraulic chamber is formed between the rotational body and the cam shaft. The hydraulic pressure control system controls the hydraulic pressure supplied to the hydraulic chamber. The lock mechanism maintains the rotational phase between the output shaft and the cam shaft in a predetermined intermediate phase through a force other than the hydraulic pressure. The lock mechanism control system drivingly controls the lock mechanism.

In this construction, the control for driving the lock mechanism, namely, for preventing and allowing relative rotation between the output shaft and the cam shaft is performed independently of the hydraulic pressure control for controlling the rotational phase between the output shaft and the cam shaft. Therefore, even in the case where the hydraulic pressure in the internal combustion engine becomes unstable, for example, when stopping or starting the vehicle-mounted engine, the control for maintaining the intermediate phase can be suitably performed by driving the lock mechanism with a high degree of reliability. Accordingly, the engine can be stopped or started at predetermined valve timings.

In the aforementioned aspect, the lock mechanism control system may be designed to electrically drive-control the lock mechanism.

In this construction, the lock mechanism is electrically drive-controlled. Therefore, even in the case where the hydraulic pressure becomes unstable, for example, when stopping or starting the vehicle-mounted engine, the control for maintaining the intermediate phase can be suitably performed by driving the lock mechanism with a high degree of reliability.

Further, in the aforementioned first aspect, the lock mechanism control system may be designed to drive-control the lock mechanism through a hydraulic pressure control system that is provided separately from the hydraulic pressure control system.

In this construction; the lock mechanism is drive-controlled through a hydraulic pressure control system that is provided separately from the hydraulic pressure control system. Therefore, even in the case where the hydraulic pressure becomes unstable, for example, in stopping or starting the vehicle-mounted engine, the control for maintaining the intermediate phase can be suitably performed by driving the lock mechanism with a high degree of reliability.

In a second aspect of the present invention, there is provided a valve timing control apparatus for an internal combustion engine including a rotational body, a cam shaft, a hydraulic chamber, a hydraulic pressure control system, a lock mechanism and an electric stopper. The rotational body is drivingly coupled to an output shaft of the internal combustion engine. The cam shaft drivingly opens and closes valves of the internal combustion engine. The hydraulic chamber changes a rotational phase between the output shaft and the cam shaft through supply of a hydraulic pressure. The hydraulic chamber is formed between the rotational body and the cam shaft. The hydraulic pressure control system controls the hydraulic pressure supplied to the hydraulic chamber. The lock mechanism maintains the rotational phase between the output shaft and the cam shaft in a predetermined intermediate phase through a force other than the hydraulic pressure. The electric stopper selectively restrains relative rotation between the cam shaft and the rotational body in the predetermined intermediate phase so as to assist retainment of the intermediate phase by the lock mechanism.

This construction is provided with the electric stopper for selectively restraining relative rotation between the cam shaft and the rotational body in the predetermined intermediate phase so as to assist retainment of the intermediate phase by the lock mechanism. Thus, the locking operation can be reliably performed by means of the lock mechanism, and the aforementioned intermediate phase can be suitably controlled.

The electric stopper makes it possible to set the lock pin opposed to its engagement hole and to ensure engagement of the lock pin thereinto.

BRIEF DESCRIPTION OF THE DRAWINGS

The foregoing and further objects, features and advantages of the present invention will become apparent from the following description of preferred embodiments with reference to the accompanying drawings, wherein.

DETAILED DESCRIPTION OF PREFERRED EMBODIMENTS

A valve timing control apparatus of an internal combustion engine according to a first embodiment of the present invention will now be described with reference to FIGS. 1 to 5.

Figure 1:
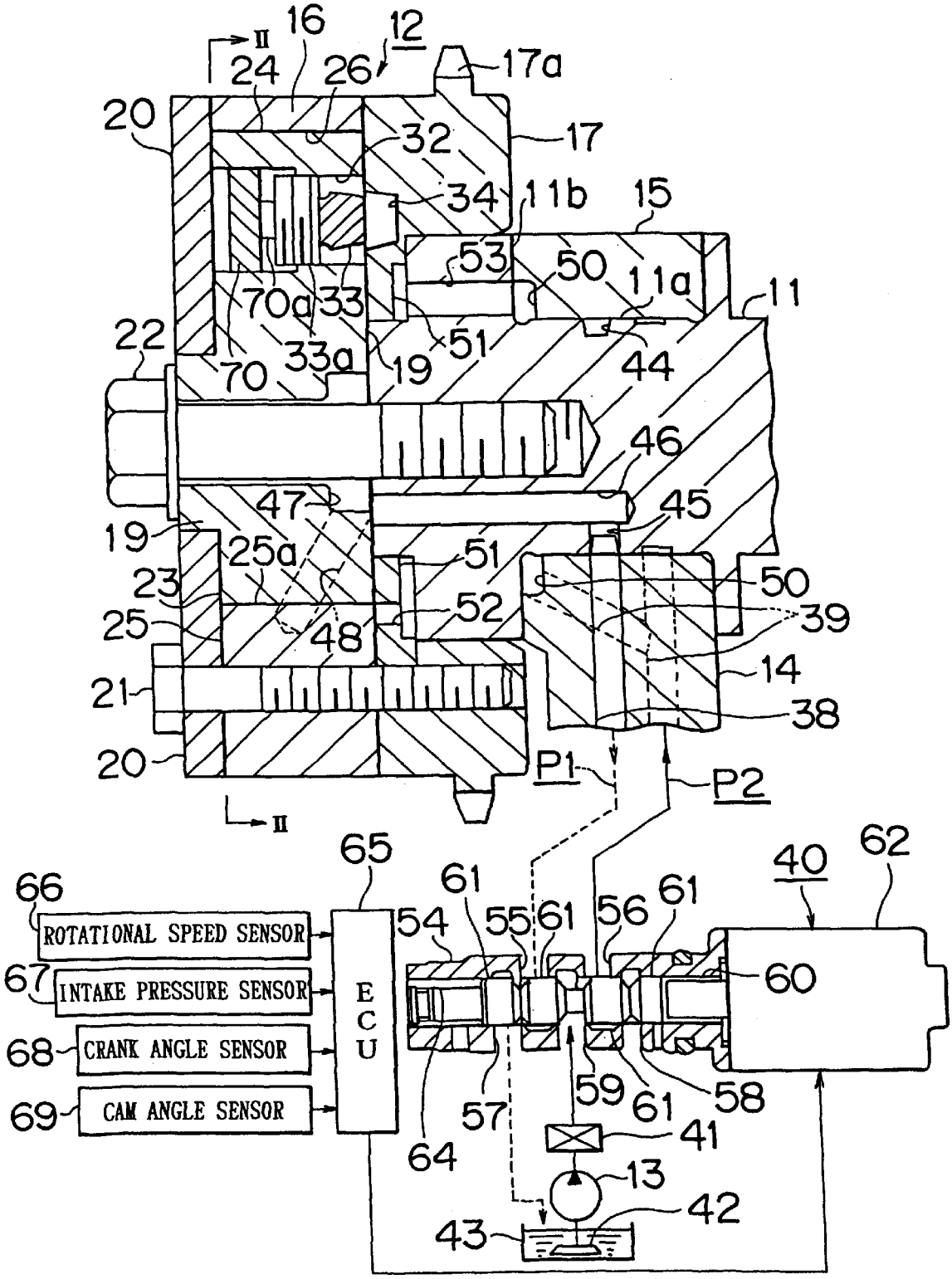
FIG. 1 is a partial sectional view of a valve timing control apparatus according to a first embodiment of the present invention.
Figure 2:
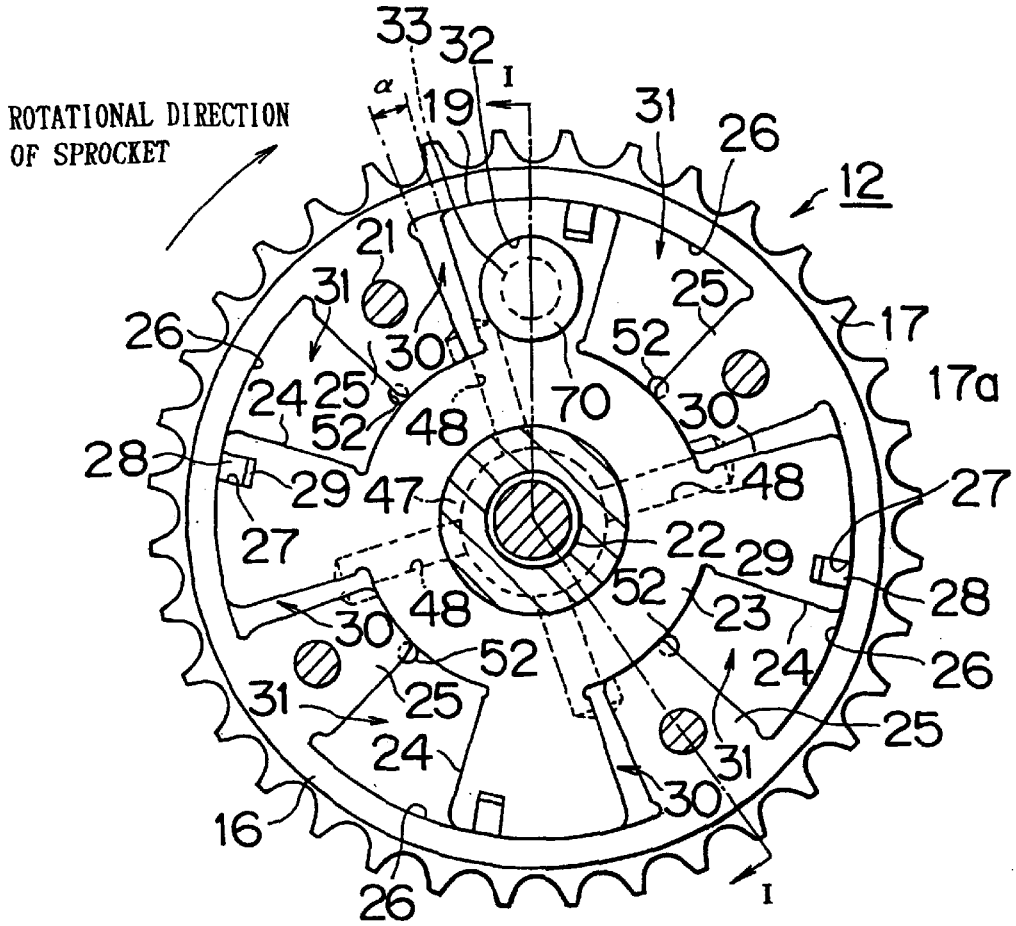
FIG. 2 is a sectional view taken along line II—II in FIG. 2.

As shown in FIGS. 1 and 2, the valve timing control apparatus of this embodiment is mainly composed of a variable valve timing mechanism (VVT) 12, an oil control valve (OCV) 40, an engine control unit (ECU) 65 and the like. The engine control apparatus 65 performs variable control of the VVT 12 by controlling the OCV 40 in accordance with an operation control of the engine. FIG. 1 mainly shows a cross-sectional structure of the VVT 12 at a leading end portion of an intake-side cam shaft (hereinafter referred to simply as "cam shaft") 11, and shows a partial cross-sectional structure of the OCV 40. FIG. 2 is a sectional view taken along line II—II in FIG. 1, while FIG. 1 is a sectional view taken along line I—I in FIG. 2.

Referring to FIGS. 1 and 2, the structure of respective portions of the valve timing control apparatus according to the first embodiment will be described.

As shown in FIG. 1, an upper end portion of a cylinder head 14 and a bearing cap 15 rotatably support a cam shaft 11 through a journal portion 11*a* thereof. The cam shaft 11 has at a leading end portion thereof a radially widened portion 11*b*. A sprocket 17, which is rotatably provided on an outer periphery of the radially widened portion 11*b*, has outer teeth 17*a*. A timing chain (not shown) is hung over outer peripheries of the outer teeth 17*a*. The timing chain transmits a rotational force of a crank shaft (not shown) to the sprocket 17.

The cam shaft 11 has on the side of its base end (on the right side in FIG. 1) a plurality of cams (not shown). These cams abut on upper end portions of intake valves (not shown). In accordance with a rotation of the cam shaft 11, the respective cams open and close the intake valves.

A housing 16 and a housing cover (front cover) 20 are fixed to the sprocket 17 by means of a bolt 21 and rotate integrally with the sprocket 17. On the 30 other hand, a rotor 19, which is attached to a leading end face of the cam shaft 11 by means of a bolt 22, is fixed to the cam shaft 11 by means of a knock pin (not shown) and rotates integrally with the cam shaft 11.

As shown in FIG. 2, the rotor 19 is provided with a cylindrical boss 23 and four vanes (pressure-receiving vanes) 24. The boss 23 is located in a central portion of the rotor 19. The four vanes 24 are formed at angular intervals of 90° around the boss 23.

The housing 16 has therein four protruding portions 25, which protrude toward the center and are disposed at predetermined intervals. Each of concave portions 26 formed between two of the protruding portions 25 accommodates a corresponding one of the vanes 24 of the rotor 19. An outer peripheral face of each of the vanes 24 is in contact with an inner peripheral face of the concave portion 26. An inner peripheral face of each of the protruding portions 25 is in contact with an outer peripheral face of the boss 23.

The vanes 24 have grooves 27, each of which is formed in an outer peripheral face of a corresponding one of the vanes 24. Each of seal plates 28 is disposed in a corresponding one of the grooves 27. Each of the seal plates 28 is in contact with the inner peripheral face of a corresponding one of the concave portions 26, each of which is formed between two of the protruding portions 25. Each of leaf springs 29 designed as an elastic member is disposed between one of the seal plates 28 and a bottom wall of a corresponding one of the groove portions 27. Each of the leaf springs 29 presses a corresponding one of the seal plates 28 toward an inner peripheral face of a corresponding one of the concave portions 26. Each of the seal plates 28 seals a gap between an outer peripheral face of a corresponding one of the vanes 24 and an inner peripheral face of a corresponding one of the concave portions 26 formed in the housing 16.

On the other hand, a housing cover 20 (FIG. 1) covers leading end side faces of the housing 16 and the rotor 19. Each of the vanes 24 divides each of four spaces surrounded by the cover 20, a corresponding one of the concave portions 26 of the housing 16, the boss 23 and a side plate 18 into two hydraulic chambers 30 and 31.

To advance the valve timing, oil is supplied to the advancement hydraulic chamber 30, which is located on the side of the vane in a direction (hereinafter referred to as a "retardation direction") opposite to a rotational direction (indicated by an arrow in FIG. 2) of the sprocket 17. On the other hand, to retard the valve timing, oil is supplied to the retardation hydraulic chamber 31, which is located on the side of the vane in the same direction (hereinafter referred to as an "advancement" direction) as the rotational direction of the sprocket 17.

As shown in FIGS. 1 and 2, one of the vanes 24 is circular in cross section and has an accommodation hole 32 extending along an axial direction of the cam shaft 11. A lock pin 33 is movably disposed in the accommodation hole 32. As shown in FIG. 1, a screw portion 33*a* is formed along part of an outer circumference of the lock pin 33. The lock pin 33 is fixed to a shaft 70*a* of a motor 70 and moves in the axial direction of the cam shaft 11 in accordance with rotation of the motor 70. The lock pin 33 engages a lock recess portion 34 formed in the sprocket 17, whereby the location of the rotor 19 relative to the sprocket 17 (the housing 16) is fixed as shown in FIG. 2 such that a side face of each of the vanes 24 on the side of the advancement hydraulic chamber 30 is spaced apart from a corresponding one of the protruding portions 25 by a predetermined phase $\alpha$. Thereby, relative rotation between the rotor 19 and the housing 16 is restrained, and the cam shaft 11 and the housing 16 rotate integrally. Restraint of relative rotation between the rotor 19 and the housing 16 by means of the lock pin 33 prevents generation of noise resulting from an unstable operation state of the VVT 12, for example, at the time of engine start. Such noise is generated, for example, when the side face of each of the vanes 24 on the side of the advancement hydraulic chamber 30 comes into abutment on the side face of a corresponding one of the protruding portions 25.

Figure 4:
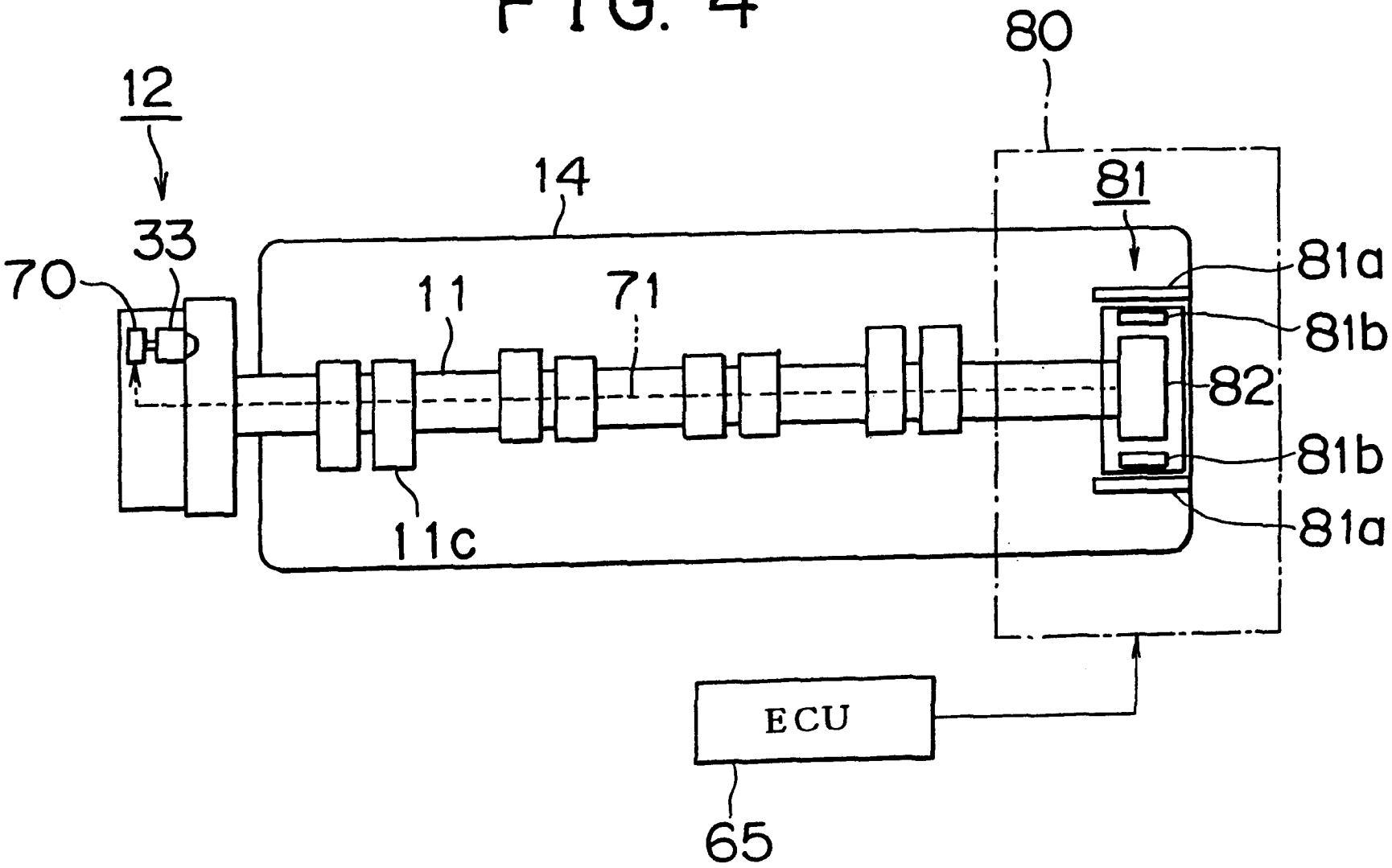
FIG. 4 is a schematic view of the overall structure of the first embodiment.

In this embodiment, as shown in FIG. 4, electric power for driving the motor 70 for moving the lock pin 33 is supplied from a power source portion 80 through a line 71. The power source portion 80 is provided at an end portion of the cam shaft 11 opposite to a side where the VVT 12 is provided.

The power source portion 80 has a generation portion 81 and a storage portion 82. The generation portion 81 is composed of a fixture (excitation) portion 81*a* provided in the cylinder head 14 and a rotation portion 81*b* provided on the cam shaft 11. The generation portion 81 generates electricity as the cam shaft 11 rotates. The storage portion 82 is composed of, for example, a secondary cell, and stores the electricity generated by the generation portion 81. The electricity stored in the storage portion 82 is supplied to the motor 70 at a predetermined timing based on a command from the ECU 65. During this period, the lock pin 33 engages the lock recess portion 34 or is released therefrom. Thus, in this embodiment, the lock pin 33 engages and is released from the lock recess portion 34 independently of hydraulic pressure control for controlling phases of the housing 16 and the rotor 19. The hydraulic pressure control will be described later.

Figure 3:
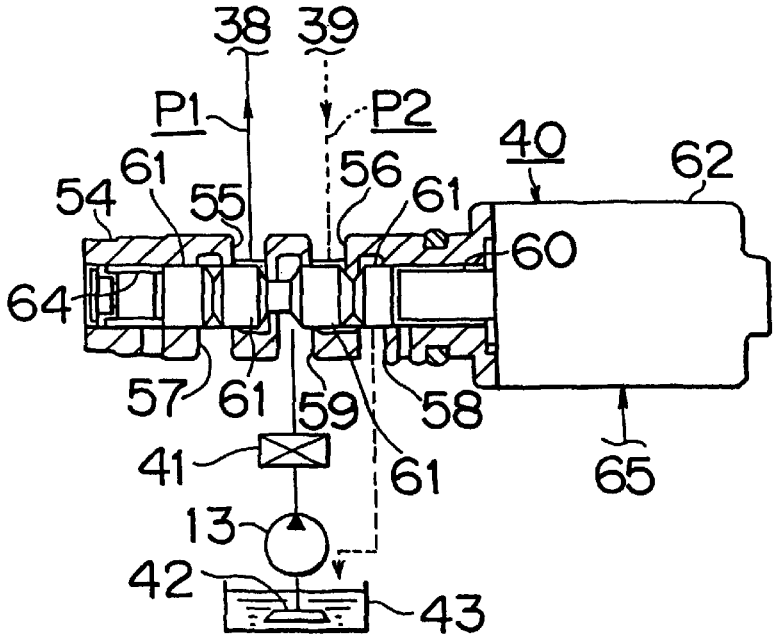
FIG. 3 is a sectional view showing an example of operation mode of an OCV.

Hydraulic passages P1 and P2, through which oil is supplied to or drained from the respective advancement hydraulic chambers 30 and the respective retardation chambers 31, will now be described with reference to FIGS. 1 to 3.

As shown in FIG. 1, an advancement-side oil path 38 and a retardation-side oil path 39 are formed inside the cylinder head 14. The oil paths 38 and 39 are connected to first and second ports 55 and 56 of the OCV 40 respectively. The first and second ports 55 and 56 will be described later. The OCV 40 leads to an oil pan 43 through an oil filter 41, a pump 13 and an oil strainer 42.

The advancement-side oil path 38 leads to an oil passage 46 formed inside the cam shaft 11 through an oil groove 44 formed over the entire circumference of the journal 11*a* and an oil hole 45 formed inside the journal 11*a*. The oil passage 46 opens on the side of a leading end thereof to an annular space 47, which is defined by a base end side inner peripheral portion of the boss 23 of the rotor 19, the bolt 22 and the sprocket 17. As shown in FIG. 2, four oil holes 48 that are radially formed in part of the respective vanes 24 and the respective protruding portions 25 connect the annular space 47 with the respective advancement hydraulic chambers 30. The oil supplied to the annular space 47 is supplied to the respective advancement hydraulic chambers 30 through the oil holes 48.

On the other hand, as shown in FIG. 1, the retardation-side oil path 39 leads to an oil groove 50 formed in the upper end portion of the cylinder head 14 and the bearing cap 15. An oil hole 53 formed in the radially widened portion 11*b* connects the oil groove 50 with an annular oil space 51 formed between the sprocket 17 and the leading end side face of the radially widened portion 11*b*. As shown in FIGS. 1 and 2, the sprocket 17 has four oil holes 52, each of which opens in the vicinity of the side face of a corresponding one of the protruding portions 25. Each of the oil holes 52 connects the oil space 51 with a corresponding one of the retardation hydraulic chambers 31. The oil in the oil space 51 is supplied to the hydraulic chambers 31.

The advancement-side oil path 38, the oil groove 44, the oil hole 45, the oil passage 46, the annular space 47 and the respective oil holes 48 constitute an advancement hydraulic passage P1 for supplying oil to the respective advancement hydraulic chambers 30. On the other hand, the retardation-side oil path 39, the oil groove 50, the oil hole 53, the oil space 51 and the respective oil holes 52 constitute a retardation hydraulic passage P2 for supplying oil to the respective retardation hydraulic chambers 31.

The OCV 40 switches a communication state between the advancement hydraulic passage P1 and the retardation hydraulic passage P2 on one side and the pump 13 and the oil pan 43 on the other side.

As shown in FIG. 1, a casing 54 constituting the OCV 40 has first to fifth ports 55 to 59. The first port 55 leads to the advancement-side oil path 38, and the second port 56 leads to the retardation-side oil path 39. The third and fourth ports 57 and 58 lead to the oil pan 43, and the fifth port 59 leads to a discharge side of the pump 13 through the oil filter 41.

A spool 60, which is reciprocally provided in the casing 54, has four cylindrical valve bodies 61. An electromagnetic solenoid 62 moves the spool 60 between a "retardation position" shown in FIG. 1 and an "advancement position" shown in FIG. 3. A spring 64, which is provided in the casing 54, urges the spool 60 toward the "retardation position".

The ECU 65 performs duty control for changing a driving mode of the electromagnetic solenoid 62. That is, the ECU 65 holds the spool 60 at the "advancement position" by driving the electromagnetic solenoid 62 with a duty ratio of 100%. Thus, as shown in FIG. 3, the advancement-side oil path 38 is connected to the discharge side of the pump 13 through the first port 55 and the fifth port 59. The retardation-side oil path 39 is connected to oil pan 43 through the second port 56 and the fourth port 58. As a result, oil is supplied to the respective advancement hydraulic chambers 30 through the advancement hydraulic passage P1, while the oil in the respective retardation hydraulic chambers 31 is returned to the oil pan 43 through the retardation hydraulic passage P2.

On the other hand, the ECU 65 holds the spool 60 at the "retardation" position by stopping conduction control for the electromagnetic solenoid 62 (with a duty ratio of 0%). Thus, as shown in FIG. 1, the retardation-side oil path 39 is connected to the discharge side of the pump 13 through the second port 56 and the fifth port 59, while the advancement-side oil path 38 is connected to the oil pan 43 through the first port 55 and the third port 57. As a result, oil is supplied to the respective retardation hydraulic chambers 31 through the retardation hydraulic passage P2, while the oil in the respective advancement hydraulic chambers 30 is returned to the oil pan 43 through the advancement hydraulic passage P1.

Furthermore, the ECU 65 holds the spool 60 at a "holding position" by driving the electromagnetic solenoid 62 with a duty ratio of 50%. At this moment, the valve body 61 of the spool 60 is held at such a position that oil can be homogeneously supplied to the advancement hydraulic passage P1 and the retardation hydraulic passage P2, so as to maintain the pressures in the advancement hydraulic chambers 30 and the retardation hydraulic chambers 31.

A rotational speed sensor 66 and an intake pressure sensor 67 (FIG. 1), which are connected to the ECU 65, detect a rotational speed of the engine and an intake pressure respectively. Likewise, a crank angle sensor 68 and a cam angle sensor 69, which are connected to the ECU 65, detect rotational phases of a crank shaft (not shown) and the cam shaft 11, respectively. Based on detection signals inputted from the respective sensors 66 to 69, the ECU 65 calculates a target rotational phase (target valve timing) of the cam shaft 11 suited for an operation state of the engine. The ECU 65 also detects an actual rotational phase (actual valve timing) of the cam shaft 11. The ECU 65 then controls the OCV 40 such that the difference between the actual and target rotational phases of the cam shaft 11 becomes equal to or smaller than a predetermined value.

Then, the operation of the thus-constructed valve timing control apparatus of this embodiment will be described. The following description will focus on the operation regarding engagement and release of the lock pin 33.

First of all, it will be described how the lock pin 33 engages the lock recess portion 34. In accordance with the first embodiment, the lock pin 33 engages the lock recess portion 34 when the engine is stopped.

Figure 5A:
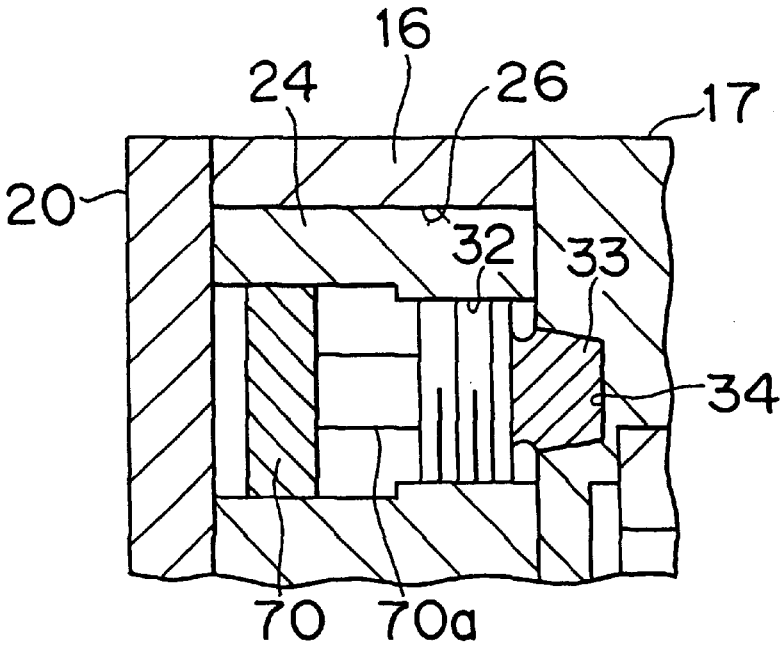
FIG. 5A is an enlarged sectional view of a state where a lock pin of the first embodiment is in engagement with a lock recess portion.

When the engine shifts from an operation state to a stopped state by turning off an ignition switch (not shown), the ECU 65 ensures a certain hydraulic pressure by controlling the OCV 40, with a view to holding the VVT 12 in a controllable state for a predetermined length of time. Based on the thus-ensured hydraulic pressure, the ECU 65 surely stops the VVT 12 in a predetermined intermediate phase where the lock pin 33 engages the lock recess portion 34. The ECU 65 also supplies the motor 70 with the electricity that has been generated by the generation portion 81 during operation of the engine and stored in the storage portion 82. Thus, as shown in FIG. 5A, the lock pin 33 surely engages the lock recess portion 34 in accordance with rotation of the motor 70. This state is then held until the engine is restarted.

Thus, in this embodiment, the lock pin 33 engages the lock recess portion 34 independently of hydraulic pressure control for controlling the VVT 12. Therefore, even in a state where the hydraulic pressure is relatively unstable, for example, immediately after stopping the engine, the lock pin 33 can surely engage the lock recess portion 34. The electric energy required in this process is obtained from the electric power generated in response to rotation of the cam shaft 11. Consequently, the effective use of energy can be accomplished.

Then, if the hydraulic pump 13 stops and the supply of oil to the engine is stopped, the oil in the retardation hydraulic chambers 31 and the advancement hydraulic chambers 30 is returned to the oil pan. Hence, the hydraulic pressures in the retardation hydraulic chambers 31 and the advancement hydraulic chambers 30 also fall.

Next, it will be described how the lock pin 33 is released from the lock recess portion 34. The lock pin 33 is released from the lock recess portion 34 when starting the engine.

When starting the engine that has been stopped for a long time, immediately after turning on the ignition switch, oil has not been supplied to the advancement hydraulic chambers 30 and the retardation hydraulic chambers 31. Also, at the moment of subsequent cranking of the crank shaft, the advancement hydraulic chambers 30 and the retardation hydraulic chambers 31 have not reached a sufficient level of hydraulic pressure. When the sprocket 17 is turned in accordance with the cranking, the sprocket 17, the rotor 19 and the cam shaft 11 start rotating such that they are mechanically coupled to one another in the aforementioned predetermined intermediate phase. This is because the lock pin 33 is in engagement with the lock recess portion 34 as described above.

As shown in FIG. 2, the cam shaft 11 is locked into the sprocket 17 in a phase that is advanced by, for example, a predetermined phase (angle) $\alpha$ with respect to a phase exhibiting the most delayed valve timing. Thus, unlike a valve timing control apparatus wherein the engine is started at a most retarded position, it is also possible to further retard the valve timing during operation of the engine with respect to the valve timing at the time of engine start. As described above, the predetermined phase $\alpha$ is set such that good startability of the engine can be ensured.

Figure 5B:
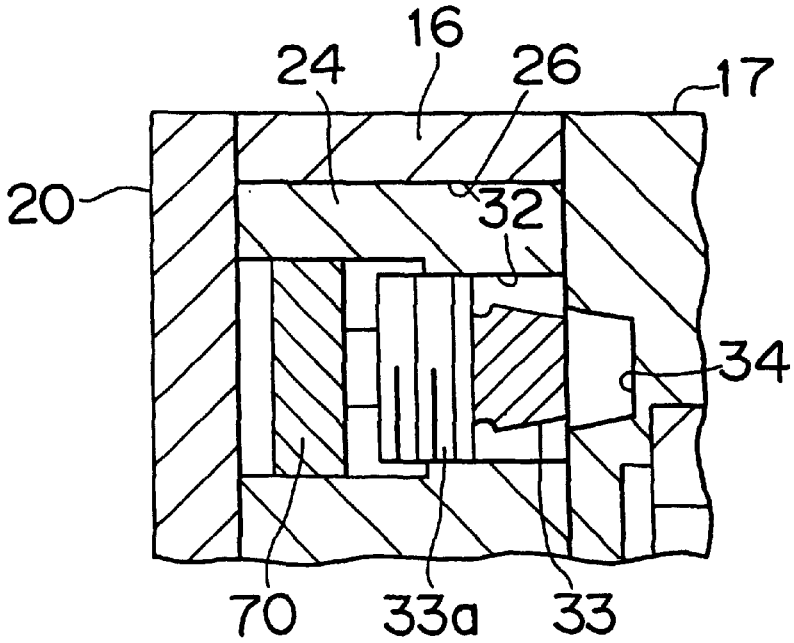
FIG. 5B is an enlarged sectional view of a state where the lock pin of the first embodiment has been released from the lock recess portion.

Then, the supply of engine oil to the advancement hydraulic passage P1 is started in response to operation of the OCV 40 and the hydraulic pump 13. The oil is supplied to the advancement hydraulic chambers 30 through the advancement hydraulic passage P1, so that the advancement hydraulic chambers 30 are maintained at a predetermined hydraulic pressure. After that, oil is also supplied to the retardation hydraulic chambers 31 through the retardation hydraulic passage P2 in a similar manner. Then, at the timing corresponding to when the predetermined hydraulic pressure is applied to the advancement hydraulic chambers 30 and the retardation hydraulic chambers 31, the ECU 65 causes the motor 70 to rotate reversely, thereby removing the lock pin 33 from the lock recess portion 34 and storing the lock pin 33 in the accommodation hole 32. Thus, smooth rotation of the rotor 19 relative to the sprocket 17 is permitted. FIG. 5B shows a state where the lock pin 33 has been released from the lock recess portion 34.

If the pressure in the advancement hydraulic chambers 30 further increases and the pressure in the retardation hydraulic chambers 31 decreases after release of the lock pin 33, the rotor 19 rotates relative to the sprocket 17 clockwise in FIG. 2, based on a difference in pressure between the advancement hydraulic chambers 30 and the retardation hydraulic chambers 31 that are located on opposite sides of the respective vanes 24. As a result, the rotational phase of the intake-side cam shaft 11 with respect to the crank shaft is advanced, so that the valve timing of the intake valves is advanced.

On the other hand, if the pressure in the retardation hydraulic chambers 31 further increases and the pressure in the advancement hydraulic chambers 30 decreases, the rotor 19 rotates relative to the sprocket 17 counterclockwise in FIG. 2, based on a difference in pressure between the advancement hydraulic chambers 30 and the retardation hydraulic chambers 31 that are located on opposite sides of the respective vanes 24. As a result, the rotational phase of the intake-side cam shaft 11 with respect to the sprocket 17, namely, with respect to the crank shaft is retarded, so that the valve timing of the intake valves is retarded.

Furthermore, after release of the lock pin 33, if oil is supplied to the advancement hydraulic chambers 30 and the retardation hydraulic chambers 31 homogeneously due to the control of the OCV 40, the cam shaft 11 stops rotating relative to the sprocket 17. As a result, the valve timing of the intake valves is maintained as it is.

As described hitherto, the following effects can be achieved by this embodiment.

In accordance with the first embodiment, the lock pin 33 engages the lock recess portion 34 through control of the motor 70, which is independent of hydraulic pressure control for controlling the VVT 12. Therefore, the lock pin 33 can surely engage the lock recess portion 34 even in a state where the hydraulic pressure for controlling the VVT 12 becomes unstable, for example, immediately after stopping the engine. The electric energy required in this process is obtained from the electric power generated in response to rotation of the cam shaft 11. Consequently, the effective use of energy can be accomplished.

It is also possible to modify the first embodiment as will be described below.

In accordance with the first embodiment, the electric power for driving the motor 70 to move the lock pin 33 is supplied from the power source portion 80, which is located at the end portion of the cam shaft 11 that is opposite to the side where the VVT 12 is provided. However, such a construction is not obligatory. That is, the power source portion may also be located at the end portion of the cam shaft 11 on the side where the VVT 12 is provided. Furthermore, the power source portion need not be disposed at the end portion of the cam shaft 11. The electric power for driving the motor 70 may be supplied from a component outside the engine, such as a battery mounted in the vehicle.

According to the first embodiment, a construction wherein the lock pin 33 is locked into the sprocket 17 is illustrated. However, the present invention is not limited to such a construction. For example, the lock pin 33 may be designed to be locked into the housing cover 20.

Although an example in which the storage portion 82 is composed of a secondary cell (battery) is illustrated, the storage portion 82 may be composed of, for example, a capacitor or the like.

According to the first embodiment, an example in which the motor 70 electrically drive-controls a locking mechanism (the lock pin 33) is illustrated. However, the present invention is not limited to such an example. For example, the locking mechanism may be designed to be electrically drive-controlled by an actuator such as a linear solenoid. In addition, it is not necessary that the locking mechanism be electrically drive-controlled. What is important is that the locking mechanism is drive-controlled by a control system separate from the one for controlling the supply of hydraulic pressure to the advancement hydraulic chambers 30 and the retardation hydraulic chambers 31 (the first and second hydraulic chambers).

A second embodiment of the present invention will now be described with reference to FIGS. 6 to 8. The following description will focus on the features that are different from those of the first embodiment. In the first and second embodiments, like members are denoted by like reference numerals, and the description of those members which are commonly employed in both the embodiments will be omitted.

Figure 6:
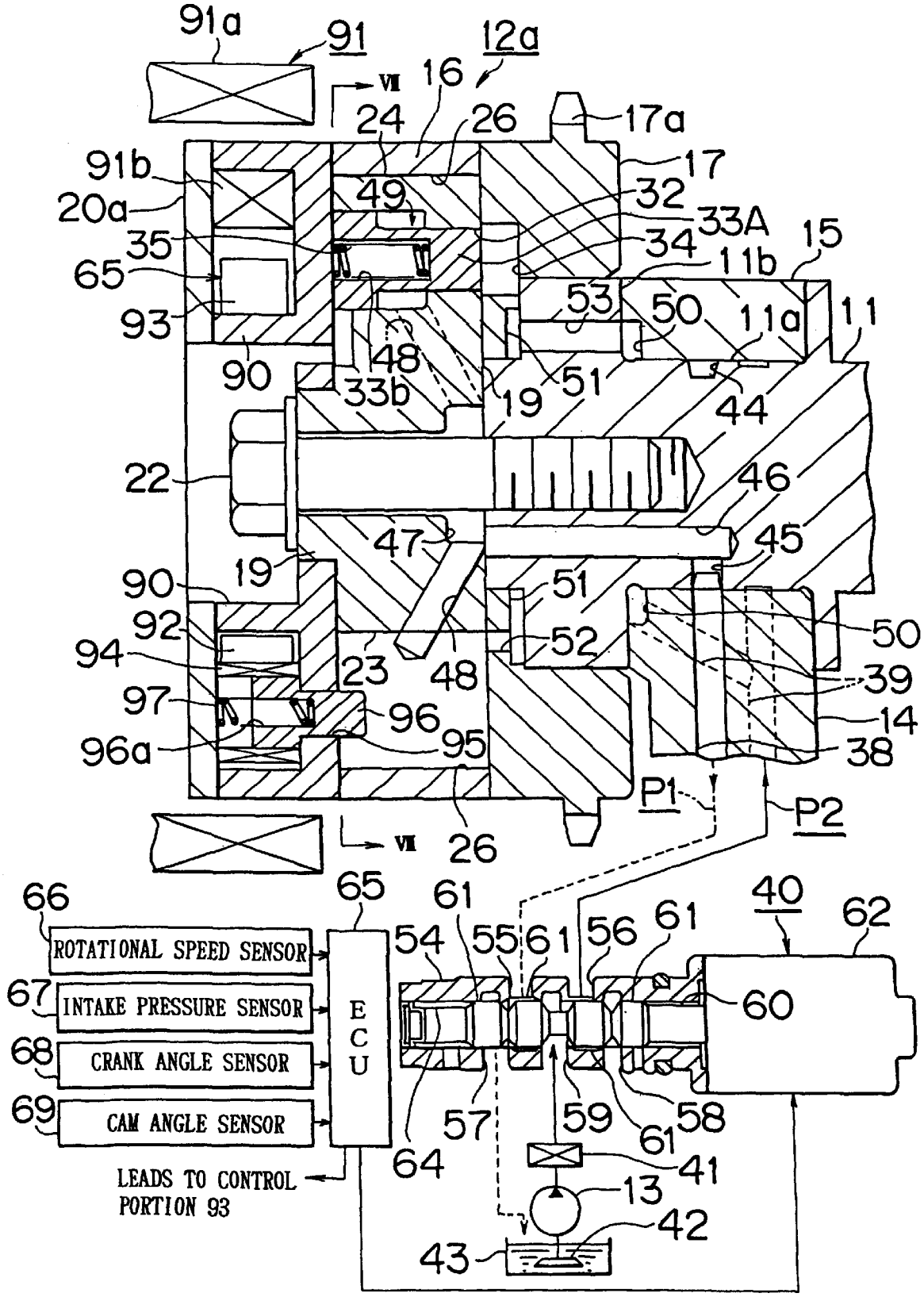
FIG. 6 is a partial sectional view of a valve timing control apparatus according to a second embodiment of the present invention.

FIG. 6 shows in cross section the structure of a VVT 12*a*, the OCV 40 and the like of a valve timing control apparatus according to the second embodiment of the present invention. Like those shown in FIG. 1, the VVT 12*a*, the OCV 40 and the like are provided on the side of the leading end of the intake-side cam shaft 11. FIG. 6 is a sectional view taken along line VI—VI in FIG. 7, while FIG. 7 is a sectional view taken along line VII—VII in FIG. 6. FIG. 8 schematically shows the structure of the valve timing control apparatus of this embodiment.

Figure 7:
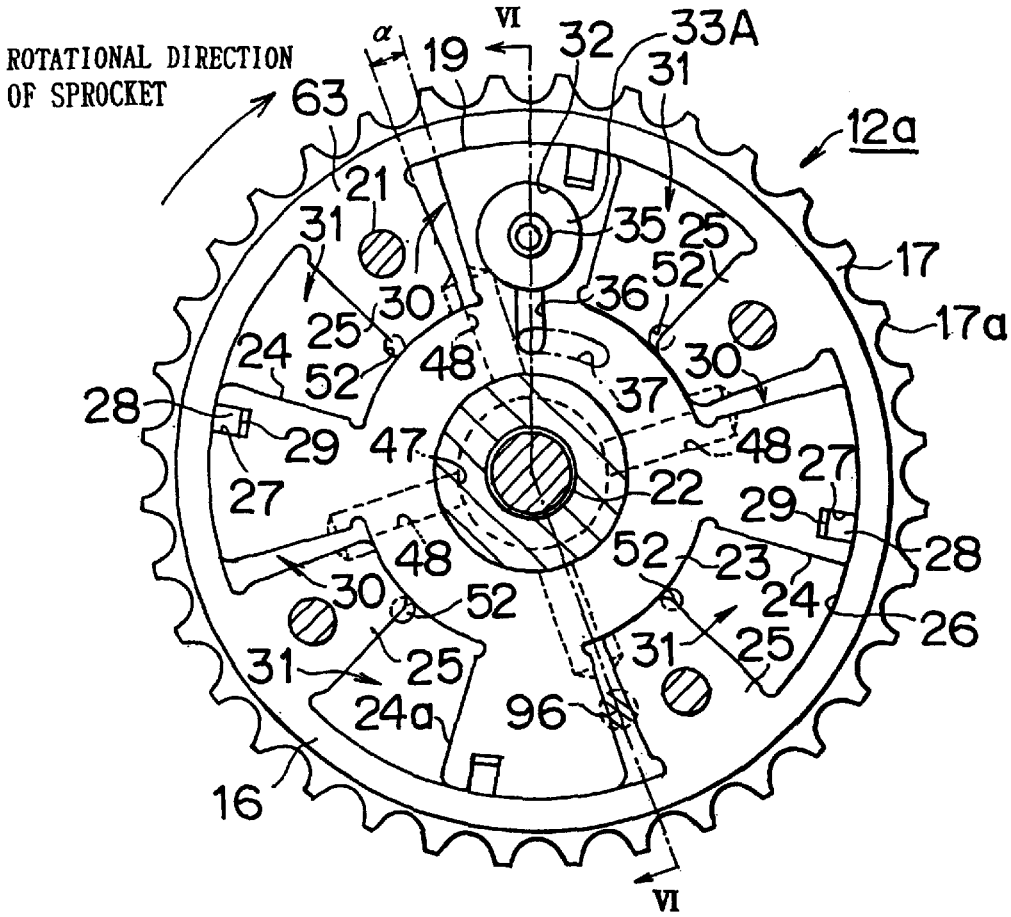
FIG. 7 is a sectional view taken along line VII—VII in FIG. 6.
Figure 8:
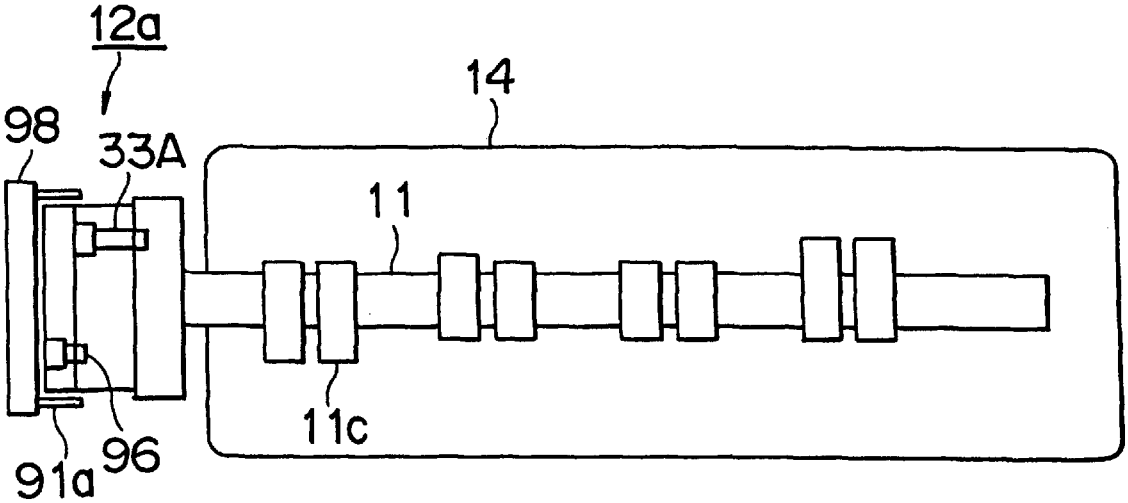
FIG. 8 is a schematic view of the overall structure of the second embodiment.

As shown in FIGS. 6 to 8, the valve timing control apparatus of this embodiment is different from that of the first embodiment in that the VVT 12*a* is provided with an electric stopper 96.

As in the aforementioned previously employed valve timing control apparatus, the displacement of a lock pin 33A of this embodiment is hydraulically controlled. That is, a hydraulic chamber 49, which is surrounded by the outer peripheral wall of the lock pin 33A and the inner peripheral wall of a through hole 32, leads to the annular space 47 through one of the oil holes 48. If the hydraulic pressure in the hydraulic chamber 49 increases after engine start, the lock pin 33A is disengaged from an engagement hole 34.

In these respects, this embodiment is different from the first embodiment. The construction and operation relating to the electric stopper 96 will specifically be described hereinafter.

As shown in FIG. 6, an accommodation portion 90 for the electric stopper 96 is provided in a front face of the VVT 12*a* (at the left end in FIG. 6). A through hole 95 is formed in a side wall of the accommodation portion 90. The through hole 96 has a circular cross section, extends in the axial direction of the cam shaft 11, and opens to one of the concave portions 26.

The electric stopper 96, which is movable within the through hole 95, is provided in the accommodation portion 90. The electric stopper 96 has therein an accommodation hole 96*a* in which a spring 97 is provided. The spring 97 urges the electric stopper 96 in such a direction as to project into the corresponding concave portion 26. As can be seen from FIG. 7, because the electric stopper 96 thus projects into the predetermined concave portion 26, the rotor 19 is kept from moving relative to the housing 16 at a position where the side face of each of the vanes 24 is spaced apart from a corresponding one of the protruding portions 25 by a predetermined phase $\alpha$ on the side of the respective advancement hydraulic chambers 30. In the valve timing control apparatus of this embodiment, the lock pin 33A engages the lock recess portion 34 at the aforementioned position. That is, when the lock pin 33A engages the lock recess portion 34A, the cam shaft 11 is locked into the sprocket 17 in a phase that is advanced by a predetermined phase (angle) $\alpha$ with respect to a phase realizing the most retarded valve timing.

As shown in FIG. 6, an electromagnetic coil 94 for putting the electric stopper 96 into the accommodation portion 90 from the concave portion 26 against an urging force of the spring 97 is provided in the accommodation portion 90. Also, a storage portion 92 for supplying electricity to the electromagnetic coil 94 and a control portion 93 for charging and discharging the storage portion 92 are provided in the accommodation portion 90. It is to be noted herein that the storage portion 92 is composed of a capacitor having a capacitance corresponding to the drive of the electric stopper 96. In this manner, the storage portion 92 is made compact. Furthermore, a rotation portion 91*b* of a generation portion 91 for charging the storage portion 92 is provided in the accommodation portion 90. A fixed (excitation) portion 91*a* of the generation portion 91 is provided, for example, on a chain cover 98 (FIG. 8).

The ECU 65 performs control for supplying electricity to the electromagnetic coil 94 from the storage portion 92. More specifically, upon detecting through the rotational speed sensor 66 that the rotational speed of the engine has reached a predetermined value, the ECU 65 outputs a command signal to the control portion 93 so as to discharge electricity from the storage portion 92 to the electromagnetic coil 94. At this moment, the electromagnetic coil 94 is excited and operates to displace the electric stopper 96 from the concave portion 26 toward the accommodation portion 90 against an urging force of the spring 97. Owing to such operation of the electromagnetic coil 94, the electric stopper 96 is kept from projecting into the concave portion 26.

On the other hand, if the rotational speed of the engine remains below the predetermined value, the ECU 65 stops outputting the discharge command signal to the control portion 93. Thereby the electromagnetic coil 94 is kept from being excited, and the electric stopper 96 projects again into the concave portion 26 due to the urging force of the spring 97.

The electric power generated by the generation portion 91 in response to rotation of the cam shaft 11 is supplied to the storage portion 92, and the control portion 93 performs control for charging the storage portion 92. At this moment, the electric power supplied to the electromagnetic coil 94 is temporarily stored in the storage portion 92 and therefore stabilized. The power source for driving the electric stopper 96 is provided in the VVT 12*a*, whereby connecting lines and the like can be omitted, which would be necessitated in the case where the power source is provided outside the VVT 12*a*.

Next, the operation of the aforementioned construction of this embodiment will be described. As in the first embodiment, the following description will focus on operations relating to engagement and release of the lock pin 33A.

First of all, it will be described how the lock pin 33A engages the lock recess portion 34.

In accordance with the second embodiment, the lock pin 33A engages the lock recess portion 34 basically in stopping the engine. That is, if the engine is stopped, the supply of oil to the engine is stopped, and the oil in the retardation hydraulic chambers 31 and the advancement hydraulic chambers 30 is returned to the oil pan.

If the oil is returned, the hydraulic pressure applied to the lock pin 33A drops, and the lock pin 33A is displaced toward the sprocket 17 due to an urging force of the spring 35. Furthermore, in thus stopping the engine, based on counterforces generated by the intake valves, the rotor 19 of the VVT 12*a* rotates relative to the sprocket 17 counterclockwise (See FIG. 7). In response to such relative rotation, one of the vanes 24*a* comes into abutment on the electric stopper 96, whose side face on the side of the advancement hydraulic chambers 30 projects into the concave portion 26 in response to the stopping of the engine.

At this moment, as described above, the lock pin 33A faces the lock recess portion 34, which the lock pin 33A surely engages due to the urging force of the spring 35.

Even in the case where the lock pin 33A has happened to fail to engage the lock recess portion 34 in stopping the engine, for example, because one of the vanes 24*a* abuts on the electric stopper 96 insufficiently, the engagement is ensured the next time the engine is started.

That is, immediately after starting the engine, the respective portions of the VVT 12*a* are not at a sufficient level of hydraulic pressure, and the rotor 19 is pressed toward the retardation side in response to rotation of the sprocket 17. Hence, the side face of one of the vanes 24*a* that is located on the side of the advancement hydraulic chambers 30 again comes into abutment on the electric stopper 96, and the lock pin 33A again comes to a location facing the lock recess portion 34. At this moment, the lock pin 33A engages the lock recess portion 34 due to the urging force of the spring 35. Since the engine is being started, the rotational speed thereof has not reached the aforementioned predetermined value. Therefore, the electric stopper 96 projects into the concave portion 26 owing to the urging force of the spring 97.

Thus, according to the second embodiment, even if the lock pin 33A has happened to fail to engage the lock recess portion 34 when the engine is stopped, the engagement is ensured when the engine is started. In other words, the reliability of the lock pin 33A when engaging the lock recess portion 34 is enhanced.

Next, it will be described how the lock pin 33A is released from the lock recess portion 34.

If the engine is started, the oil that has been sucked by the pump 13 into the oil pan 43 is forcibly delivered into the advancement hydraulic passage P1 through control of the OCV 40. After the lapse of a predetermined length of time, the hydraulic pressure in the hydraulic chamber 49 that is in communication with the advancement hydraulic passage P1 increases, and the lock pin 33A is released from the lock recess portion 34 due to the thus-increased hydraulic pressure. At this moment, the rotational speed of the engine has already reached the predetermined value. The electromagnetic coil 94 is excited and operates to displace the electric stopper 96 from the concave portion 26 toward the accommodation portion 90.

Thereby the rotor 19 is allowed to rotate relative to the sprocket 17 (the housing 16) to the maximum possible extent. The intake valves are opened and closed at predetermined valve timings corresponding to the phase of the rotor 19 relative to the sprocket 17.

As described hitherto, the following effects can be achieved by the second embodiment of the present invention.

In the second embodiment, the electric stopper 96 is provided to regulate a phase relationship between the sprocket 17 (the housing 16) and the rotor 19 in the predetermined intermediate phase that enables the lock pin 33 to engage the lock recess portion 34. Therefore, even if the hydraulic pressure for controlling the VVT 12*a* drops, for example, when the engine is stopped, the urging force of the spring 35 ensures that the lock pin 33A engages the lock recess portion 34.

Also, in the second embodiment, the electricity stored in the storage portion 92 is supplied to the electromagnetic coil 94 if it is detected that the rotational speed of the engine has reached the predetermined value. Therefore, even if the lock pin 33A has happened to fail to engage the lock recess portion 34 in stopping the engine, when the engine is still at a low rotational speed immediately after the starting thereof, the electric stopper 96 remains projecting into the concave portion 26. Thus, another attempt can be made for engagement of the lock pin 33A with the lock recess portion 34. In other words, the reliability of the lock pin 33A when engaging the lock recess portion 34 is enhanced.

In addition, according to the second embodiment, the power source (the generation portion 91) for driving the electric stopper 96 is provided in the VVT 12*a* (in front of the housing 16), and the electric energy required to drive the electric stopper 96 is obtained from the electric power generated in response to rotation of the cam shaft 11. Consequently, the effective use of energy can be accomplished, and connecting lines and the like can be omitted, which would be necessitated in the case where the power source is not provided in front of the housing 16. The amount of electric energy required to drive the electric stopper 96 is small. Thus, the electric stopper 96 can be driven with a compact generation portion and with a small amount of electric power.

The electric power supplied to the electromagnetic coil 94 is temporarily stored in the storage portion 92 and therefore stabilized.

It is also possible to modify the second embodiment as will be described below.

In the second embodiment, there is a storage portion 92 composed of a capacitor. However, the storage portion may be an accumulator battery (battery) or the like.

In the second embodiment, there is a power source (the generation portion 91 or the like) for driving the electric stopper 96 provided in the VVT 12*a* (in front of the housing 16). However, the power source may be provided at an end portion of the cam shaft 11 opposite to a side where the VVT 12 is provided. Alternatively, the power source may be provided outside the engine.

In accordance with the second embodiment, there is a lock pin 33A hydraulically driven. However, as in the first embodiment, the lock pin may be electrically driven.

Figure 9:
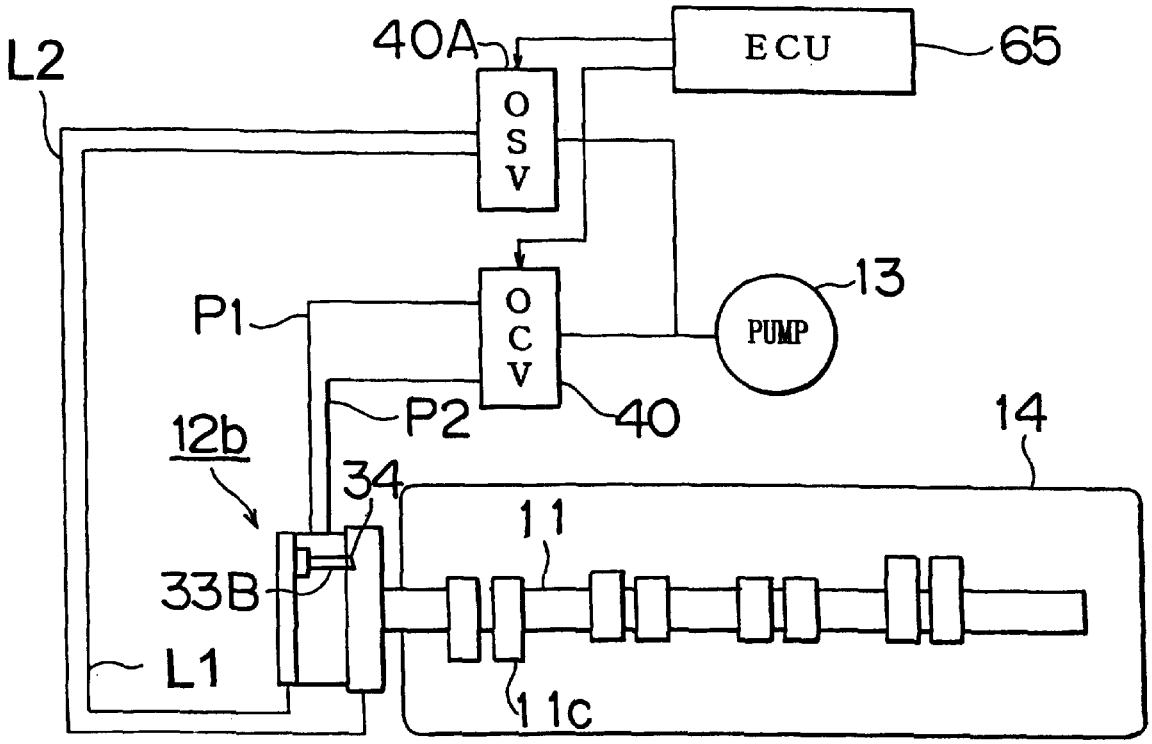
FIG. 9 is a schematic view of the overall structure of a valve timing control apparatus according to a third embodiment of the present invention.
Figure 10:
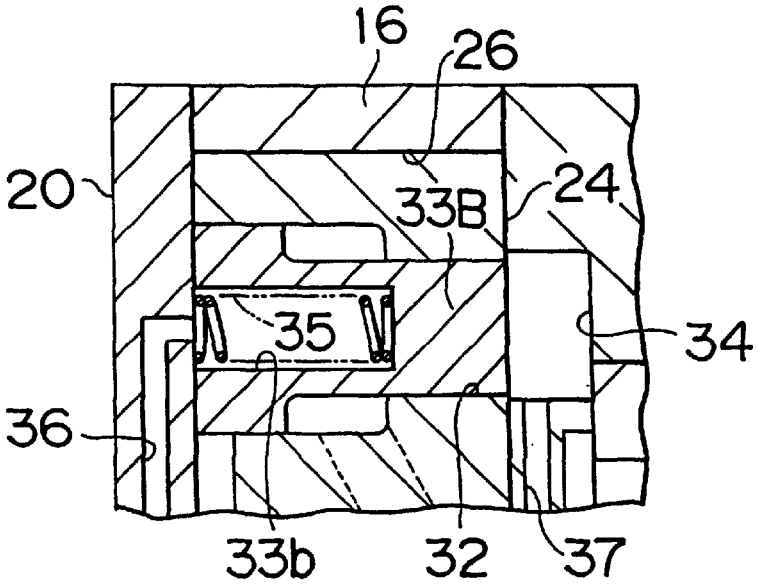
FIG. 10 is an enlarged sectional view of a lock pin and the like of the third embodiment.
Figure 11:
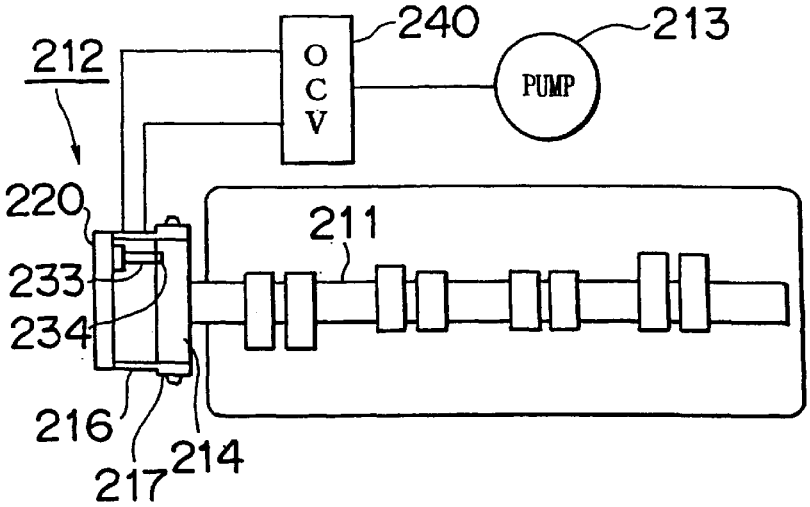
FIG. 11 PRIOR ART
FIG. 11 is a schematic view of the overall structure of an example of the valve timing control apparatus.
Figure 12:
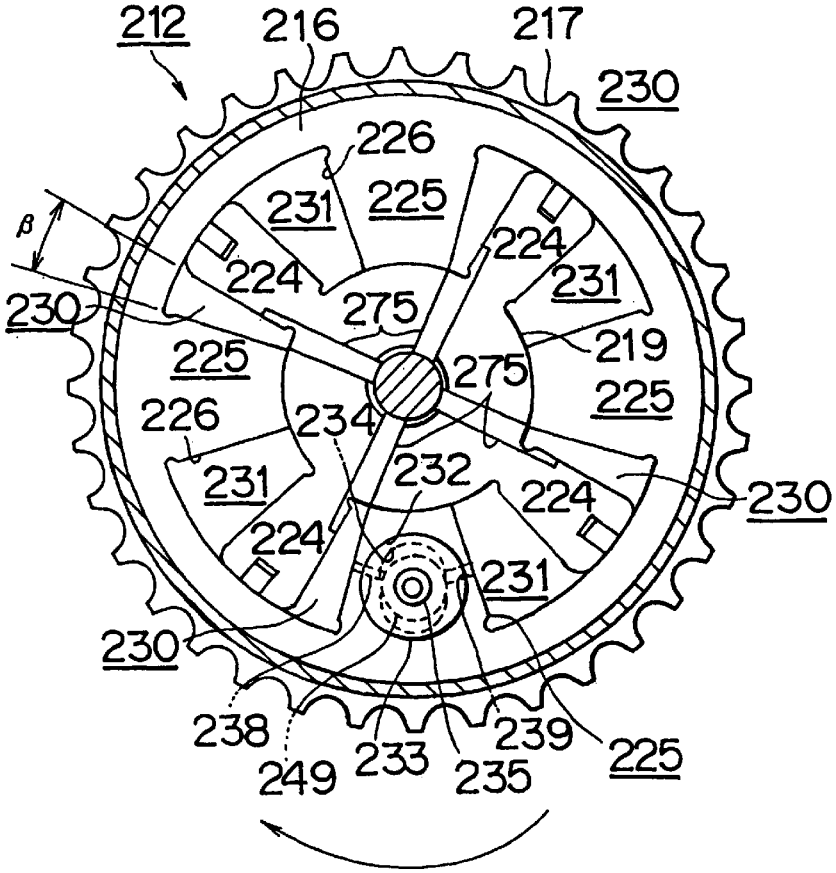
FIG. 12 PRIOR ART
FIG. 12 is a partial sectional view of the structure of the valve timing control apparatus.

A third embodiment of the present invention will now be described with reference to FIGS. 9 and 10. The following description will focus on the features that are different from those of the first and second embodiments. FIG. 9 schematically shows the structure of the third embodiment. FIG. 10 shows a partial cross section in the vicinity of the lock pin. In the first, second and third embodiments, like members are denoted by like reference numerals, and the description of those members which are commonly employed in these embodiments will be omitted.

In the valve timing control apparatus of the third embodiment, as shown in FIG. 9, the VVT 12*b* is composed of a hydraulic passage L1 for activating the lock pin and a hydraulic passage L2 for releasing the lock pin. The hydraulic passages L1 and L2 are controlled separately from the advancement hydraulic passage P1 and the retardation hydraulic passage P2.

The hydraulic passage L1 for activating the lock pin connects an oil switching valve (hereinafter referred to as an OSV) 40A with a spring accommodation hole 33*b* through an oil path 36 and the like formed in the housing cover 20. The hydraulic passage L2 for releasing the lock pin connects the OSV 40A with the lock recess portion 34A through an oil path 37 and the like formed in the sprocket 17. Like the aforementioned OCV 40, the OSV 40A is connected to the hydraulic pump 13 and the like. Based on a command from the ECU 65, the hydraulic pressure switching control for the hydraulic passages L1 and L2 is carried out separately from the control for the advancement hydraulic passage P1 and the retardation hydraulic passage P2.

Next, the operation of the aforementioned construction of the third embodiment will be described. As in the first and second embodiments, the following description will focus on operations relating to engagement and release of the lock pin 33B.

First of all, it will be described how the lock pin 33B engages the lock recess portion 34.

According to the third embodiment, as in the first and second embodiments, the lock pin 33B engages the lock recess portion 34 basically in stopping the engine. That is, when the engine transitions from an operative state to a nonoperative state after the ignition switch is turned-off, the ECU 65 controls the OCV 40 to ensure a predetermined hydraulic pressure, so that the VVT 12*b* can be controlled for a predetermined length of time. Based on the thus-ensured hydraulic pressure, the ECU 65 surely stops the VVT 12*b* in a predetermined intermediate phase where the lock pin 33B engages the lock recess portion 34. At this moment, the ECU 65 further controls the OSV 40A such that a hydraulic pressure is supplied to the hydraulic passage L1 for activating the lock pin and that a hydraulic pressure is released from the hydraulic passage L2 for releasing the lock pin. Thus, the lock pin 33B surely engages the lock recess portion 34 due to an urging force of the spring 35 as well as a hydraulic pressure supplied to the accommodation hole 33*b*. This state is thereafter maintained by the urging force of the spring 35 until the engine is restarted.

That is, according to the third embodiment, the engagement of the lock pin 33B with the lock recess portion 34 is carried out independently of the hydraulic pressure control for the advancement hydraulic passage P1 and the retardation hydraulic passage P2. Therefore, even in a state where the hydraulic pressure becomes relatively unstable, for example, immediately after stopping the engine, the lock pin 33B can surely engage the lock recess portion 34.

Next, it will be described how the lock pin 33B is released from the lock recess portion 34.

If the engine is started, the oil that has been sucked by the pump 13 into the oil pan is forcibly delivered into the OCV 40 and the OSV 40A by means of the pump 13. After the lapse of a predetermined length of time, the ECU 65 controls the OSV 40A such that a hydraulic pressure is supplied to the hydraulic passage L1 for activating the lock pin and that a hydraulic pressure is released from the hydraulic passage L2 for releasing the lock pin. Thus, the lock pin 33B is surely released from the lock recess portion 34 through a hydraulic pressure supplied thereto, against the urging force of the spring 35. After that, the released state of the lock pin 33B is maintained as long as the engine is in operation.

On the other hand, the phase of the rotor 19 relative to the sprocket 17 (the housing 16) is controlled through the OCV 40, as described above. The intake valves are opened and closed at predetermined valve timings corresponding to the phase of the rotor 19 relative to the sprocket 17 (the housing 16).

As described hitherto, the following effects can be achieved by the third embodiment.

In accordance with the third embodiment, in order to cause the lock pin 33B to engage the lock recess portion 34 or to be released therefrom, the hydraulic passage L1 for activating the lock pin and the hydraulic passage L2 for releasing the lock pin are provided, which are controlled separately from the advancement hydraulic passage P1 and the retardation hydraulic pressure P2. Therefore, even if the hydraulic pressure for controlling the VVT 12*b* becomes unstable, the lock pin 33B can surely engage the lock recess portion 34.

In addition, because there is no need to use the hydraulic pressure for controlling the VVT 12*b* in order to operate the lock pin 33B, the intermediate phase control on the side of the VVT 12*b* can be performed more reliably.

It is also possible to modify the third embodiment as will be described below.

In accordance with the third embodiment, a construction wherein the lock pin 33B is retained in the lock recess portion 34 by the urging force of the spring 35 until the engine is restarted is illustrated. However, it is possible to dispense with the spring 35. In this case, in order to ensure that the lock pin 33B is securely locked, the apparatus may be designed such that the hydraulic pressure in the hydraulic passage L1 for activating the lock pin can be maintained even after the engine is stopped.

Moreover, the first to third embodiments can also be modified as will be described below.

In the first to third embodiments, the number of the vanes 24 belonging to the rotor 19 may not be more than 3 or may not be less than 5.

In the first to third embodiments, the housing 16 and the rotor 19 are movably fixed to the sprocket 17 and the cam shaft 11 respectively. However, as a different combination, the rotor 19 and the housing 16 may be movably fixed to the sprocket 17 and the cam shaft 11 respectively.

In accordance with the first to third embodiments; shown a construction of the VVT wherein one of the vanes 24 is provided with the lock pin 33, 33A or 33B is illustrated. However, the present invention can also be applied to a construction of the VVT wherein the protruding portion of the housing 16 is provided with a lock pin.

In accordance with the first to third embodiments, an example in which the VVT is provided on the intake-side cam shaft 11 is illustrated. However, the VVT may also be provided on an exhaust-side cam shaft. Alternatively, it is also possible to provide each of the intake-side and exhaust-side cam shafts with a VVT.

While the present invention has been described with reference to what are presently considered to be preferred embodiments thereof, it is to be understood that the present invention is not limited to the disclosed embodiments or construction. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A valve timing control apparatus for an internal combustion engine including valves and an output shaft, comprising:

a rotational body drivingly coupled to the output shaft of the internal combustion engine;

a cam shaft for drivingly opening and closing the valves of the internal combustion engine;

a hydraulic chamber for changing a rotational phase between the output shaft and the cam shaft through supply of a hydraulic pressure, the hydraulic chamber being formed between the rotational body and the cam shaft; a first hydraulic pressure control system for controlling the hydraulic pressure supplied to the hydraulic chamber;

a lock mechanism for maintaining the rotational phase between the output shaft and the cam shaft in a predetermined intermediate phase through a force other than the hydraulic pressure; and a lock mechanism control system configured to electrically drive-control the lock mechanism.

2. The valve timing control apparatus according to claim 1, wherein the lock mechanism is controlled by a motor switchable between a locked position and an unlocked position.

3. The valve timing control apparatus according to claim 1, further comprising:

a generator for generating electricity based on rotation of the cam shaft, wherein the lock mechanism is drive-controlled using electric power generated by the generator as a power source.

4. The valve timing control apparatus according to claim 2, further comprising a storage means for storing electric power generated by the generator.

5. The valve timing control apparatus according to claim 4, wherein the storage means is a capacitor.

6. A valve timing control apparatus for an internal combustion engine including valves and an output shaft, comprising:

a rotational body drivingly coupled to the output shaft of the internal combustion engine;

a cam shaft for drivingly opening and closing the valves of the internal combustion engine;

a hydraulic chamber for changing a rotational phase between the output shaft and the cam shaft through supply of a hydraulic pressure, the hydraulic chamber being formed between the rotational body and the cam shaft;

a hydraulic pressure control system for controlling the hydraulic pressure supplied to the hydraulic chamber;

a lock mechanism for maintaining the rotational phase between the output shaft and the cam shaft in a predetermined intermediate phase through a force other than the hydraulic pressure; and an electric stopper for selectively restraining relative rotation between the cam shaft and the rotational body in the predetermined intermediate phase so as to assist retainment of the intermediate phase by the lock mechanism.

7. The valve timing control apparatus according to claim 6, wherein the lock mechanism includes a lock pin projecting from one of the rotational body and the cam shaft and a lock recess portion formed in the other of the rotational body and the cam shaft for engagement of the lock pin.

8. The valve timing control apparatus according to claim 6, further comprising means for monitoring rotational speed of the internal combustion engine, wherein the electric stopper selectively restrains relative rotation between the cam shaft and the rotational body in the predetermined intermediate phase only when the monitored rotational speed of the internal combustion engine is lower than a predetermined rotational speed.

9. The valve timing control apparatus according to claim 6, further comprising a generator for generating electricity based on rotation of the cam shaft, wherein the electric stopper is drive-controlled using electric power generated by the generator as a power source.

10. The valve timing control apparatus according to claim 9, further comprising means for monitoring rotational speed of the internal combustion engine, wherein the electric stopper selectively restrains relative rotation between the cam shaft and the rotational body in the predetermined intermediate phase only when the monitored rotational speed of the internal combustion engine is lower than a predetermined rotational speed.

11. The valve timing control apparatus according to claim 9, further comprising storage means for storing electric power generated by the generator.

12. The valve timing control apparatus according to claim 11, wherein the storage means is a capacitor.

13. The valve timing control apparatus according to claim 6, wherein the hydraulic chamber includes first and second hydraulic chambers, and the rotational phase between the output shaft and the cam shaft is changed by changing a ratio of hydraulic pressure in the first and second hydraulic pressures.

* * * * *

UNITED STATES PATENT AND TRADEMARK OFFICE

CERTIFICATE OF CORRECTION

PATENT NO. : 6,626,136 B2
DATED : September 30, 2003
INVENTOR(S) : Kazuhisa Mikame et al.

It is certified that error appears in the above-identified patent and that said Letters Patent is hereby corrected as shown below:

Title page,
Item [30], Foreign Application Priority Data, replace "Dec. 7, 1999" with -- Dec. 7, 1998 --.

Signed and Sealed this

Twenty-fifth Day of May, 2004

JON W. DUDAS
*Acting Director of the United States Patent and Trademark Office*